US005474251A

United States Patent [19]

Neri

[11] Patent Number: 5,474,251

[45] Date of Patent: Dec. 12, 1995

[54] SYSTEM WITH A SEPARATE UNIT FOR SUPPLYING WRAPPING MATERIAL IN STRIP FORM

[75] Inventor: Armando Neri, Bologna, Italy

[73] Assignee: G. D. Societa' Per Azioni, Bologna, Italy

[21] Appl. No.: 143,176

[22] Filed: Oct. 26, 1993

[30] Foreign Application Priority Data

Oct. 28, 1992 [IT] Italy ..... BO92A0376

[51] Int. Cl.[6] ..... B65H 19/12; B65H 19/18; B65H 19/20

[52] U.S. Cl. ..... 242/554.2; 242/555.2; 242/559.3; 242/559.4; 242/562.1

[58] Field of Search ..... 242/554, 554.2, 242/555.2, 559, 559.1, 559.3, 559.4, 562.1

[56] References Cited

U.S. PATENT DOCUMENTS

| | | | |
|---|---|---|---|
| 4,441,662 | 4/1984 | Seragnoli | 242/559 X |
| 4,553,712 | 11/1985 | Krywiczanin et al. | 242/554 |
| 4,589,811 | 5/1986 | Riccardo et al. | 242/559.1 X |
| 4,764,078 | 8/1988 | Neri . | |
| 4,821,972 | 4/1989 | Grollimund . | |
| 4,840,321 | 6/1989 | Focke et al. | 242/559.1 X |
| 4,951,893 | 8/1990 | Yuito | 242/554 |
| 5,101,701 | 4/1992 | Boldrini | 83/13 |
| 5,249,757 | 10/1993 | Draghetti et al. | 242/559.1 |
| 5,289,985 | 3/1994 | Cocchi et al. | 242/559 |

FOREIGN PATENT DOCUMENTS

| | | |
|---|---|---|
| 0189761 | 8/1986 | European Pat. Off. . |
| 4041865 | 7/1992 | Germany . |
| 2145046 | 7/1987 | United Kingdom . |
| 2245247 | 1/1992 | United Kingdom . |

*Primary Examiner*—John M. Jillions
*Attorney, Agent, or Firm*—Ladas & Parry

[57] ABSTRACT

A system featuring an operating section defined by at least one machine employing strips of wrapping material; and an automatic strip supply unit detached from the operating section and wherein a number of passive unwinding stations arranged side by side and each supporting a respective reel for a respective strip are selectively connectable to an active robot traveling along the unwinding stations and in turn comprising an operating module selectively connectable to each station for forming, in conjunction with each station, a device for replacing the runout reels.

10 Claims, 6 Drawing Sheets

SYSTEM WITH A SEPARATE UNIT FOR SUPPLYING WRAPPING MATERIAL IN STRIP FORM

BACKGROUND OF THE INVENTION

The present invention relates to a system with a separate unit for supplying wrapping material in strip form.

The present invention may be used to advantage on product manufacturing and packing systems in general, and, in particular, cigarette manufacturing and processing systems to which the following description refers specifically, but purely by way of example.

Cigarette manufacturing and processing systems—by which the term "processing" is intended to mean packing the cigarettes in packets of any type, and/or in cartons of any type, and/or in packs of cartons—normally comprise a number of machines fed with different types of strip material wound off reels normally mounted on the machines themselves, and which, on running out, are normally replaced with new reels by automatic strip change devices also mounted on the machines.

In view of the high operating speed of the machines, and consequently the large amount of strip material consumed, a major problem encountered on systems of the aforementioned type is that of supplying a relatively large number of reels to various parts of the system, while at the same time minimizing the amount of labour required, and keeping the floor space between the machines relatively clear, i.e. preventing an accumulation of new reels close to each machine.

Moreover, the automatic strip change devices on the machines are invariably not only expensive but also relatively cumbersome, and such as to at least partially affect the design of the machines themselves.

British Patent n. 2,145,046 and U.S. Pat. No. 4,764,078 relate to cigarette manufacturing and processing systems wherein the machines are connected to a centralized full-reel store by means of a traveling robot-operated store comprising a carriage supporting a given number of reels, and having a loading-unloading arm for picking up the full reels from the centralized store, unloading them on to the carriage, and transferring them to the strip change devices of individual machines.

Though the above known system does in fact provide for keeping the floor space between the machines clear, and for minimizing the amount of labour required, it fails to provide for eliminating the need to provide each machine with its own strip change device.

The latter problem is to some extent solved by the system described in British Patent Application n. 2,245,247 wherein the strip change devices are detached from the machines and grouped into a single strip change unit. Though this considerably simplifies both design of the machines and supply of the full reels, which in this case are fed to only one part of the system, it undoubtedly fails to provide for reducing the cost of the strip change devices—which are simply transferred from the machines to the separate strip change unit—or for solving the problems posed by supplying the full reels to each strip change device.

SUMMARY OF THE INVENTION

It is an object of the present invention to perfect the above known system in such a manner as to drastically reduce the cost of the separate strip change unit.

A further object of the present invention is to render the separate strip change unit fully automatic.

According to the present invention, there is provided a system with a separate strip change unit for supplying wrapping material in strip form; the strip change unit comprising a series of unwinding stations, each supporting a respective reel for a respective runoff strip; and the system comprising, in addition to said strip change unit, an operating section detached from the strip change unit and defined by at least one machine employing strips of wrapping material; characterized by the fact that the strip change unit comprises a robot traveling along the unwinding stations and in turn comprising an operating module selectively connectable to each station so as to constitute, in conjunction with each said station, a device for replacing the runout reels.

BRIEF DESCRIPTION OF THE DRAWINGS

A non-limiting embodiment of the present invention will be described by way of example with reference to the accompanying drawings, in which.

DETAILED DESCRIPTION OF THE INVENTION

Figure 1:
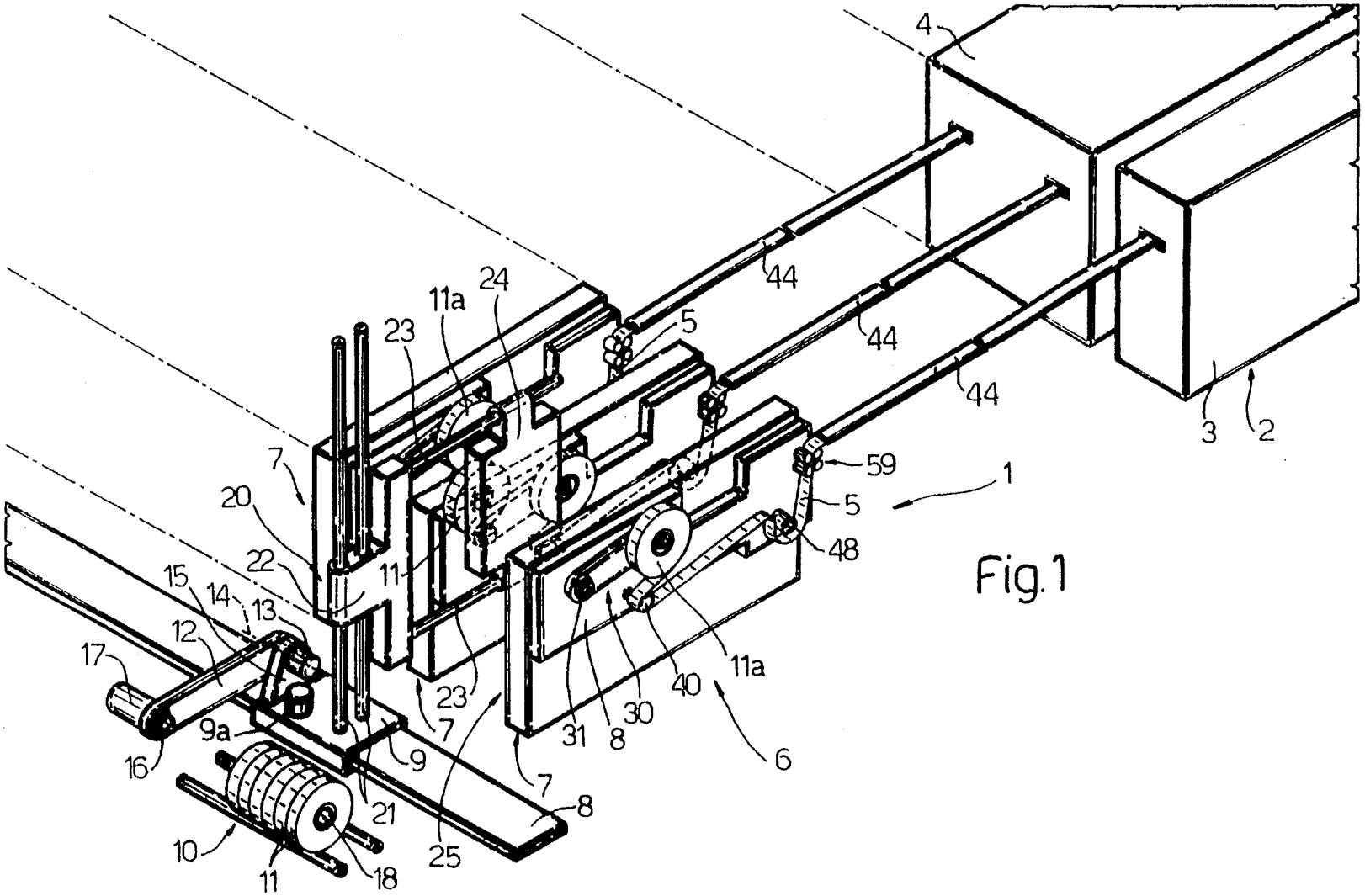
FIG. 1 shows a schematic view in perspective, with parts removed for clarity, of a preferred embodiment of the system according to the present invention.

Numeral 1 in FIG. 1 indicates a system for producing tobacco products, in particular cigarettes, and wherein an operating section 2 comprises a first machine 3 and at least one further machine 4, both designed to receive strips 5 of wrapping material from a separate strip change unit 6 comprising an unwinding station 7 for each strip 5.

Stations 7 are aligned in a group along the slideway 8 of a carriage 9 with a drive motor 9*a*. Carriage 9 is located on the opposite side of stations 7 to that facing operating section 2, and is interposed between stations 7 and a number of stores 10 (only one shown for the sake of simplicity in FIG. 1) for a number of full reels 11.

Stores 10 and carriage 9 form part of unit 6, which also comprises a loading arm 12 rotated by a motor 13 about an axis 14 parallel to slideway 8, and fitted to a bracket 15 integral with carriage 9. The free end of arm 12 presents a connecting pin 16 movable axially, in relation to arm 12 and by virtue of an actuator 17, between a withdrawn idle position and an extracted operating position, and movable transversely, together with arm 12, between a pickup position, wherein pin 16 is aligned with the core 18 of a full reel 11 in store 10, and a release position described in detail later on.

Slideway 8 and carriage 9 respectively form the slideway and base of a strip change robot 20 forming part of unit 6, and which also comprises two slideways 21 extending vertically upwards from carriage 9; a powered slide 22 movable along slideways 21 between a raised position higher than the top of stations 7, and a lowered position on a level with stations 7; a further two slideways 23 extending horizontally from slide 22 towards stations 7; and a further slide 24 movable along slideways 23 between a backup position in which it is interposed between slide 22 and stations 7, and a forward position in which, when slide 22 is lowered, slide 24 is located facing a station 7 and inside a channel 25 defined by said station 7 and an adjacent station 7.

Slide 24 supports a module 26 (shown in FIGS. 3 to 6 and described in detail later on) selectively connectable to each station 7, and which provides for automatically supplying stations 7 with full reels 11 with which to replace runout reels 11*a* (hereinafter, 11*a* generally indicates a runoff reel), and, during replacement of reels 11*a*, for powering stations 7, which are substantially passive, whereas module 26 is an active actuating module.

Figure 5:
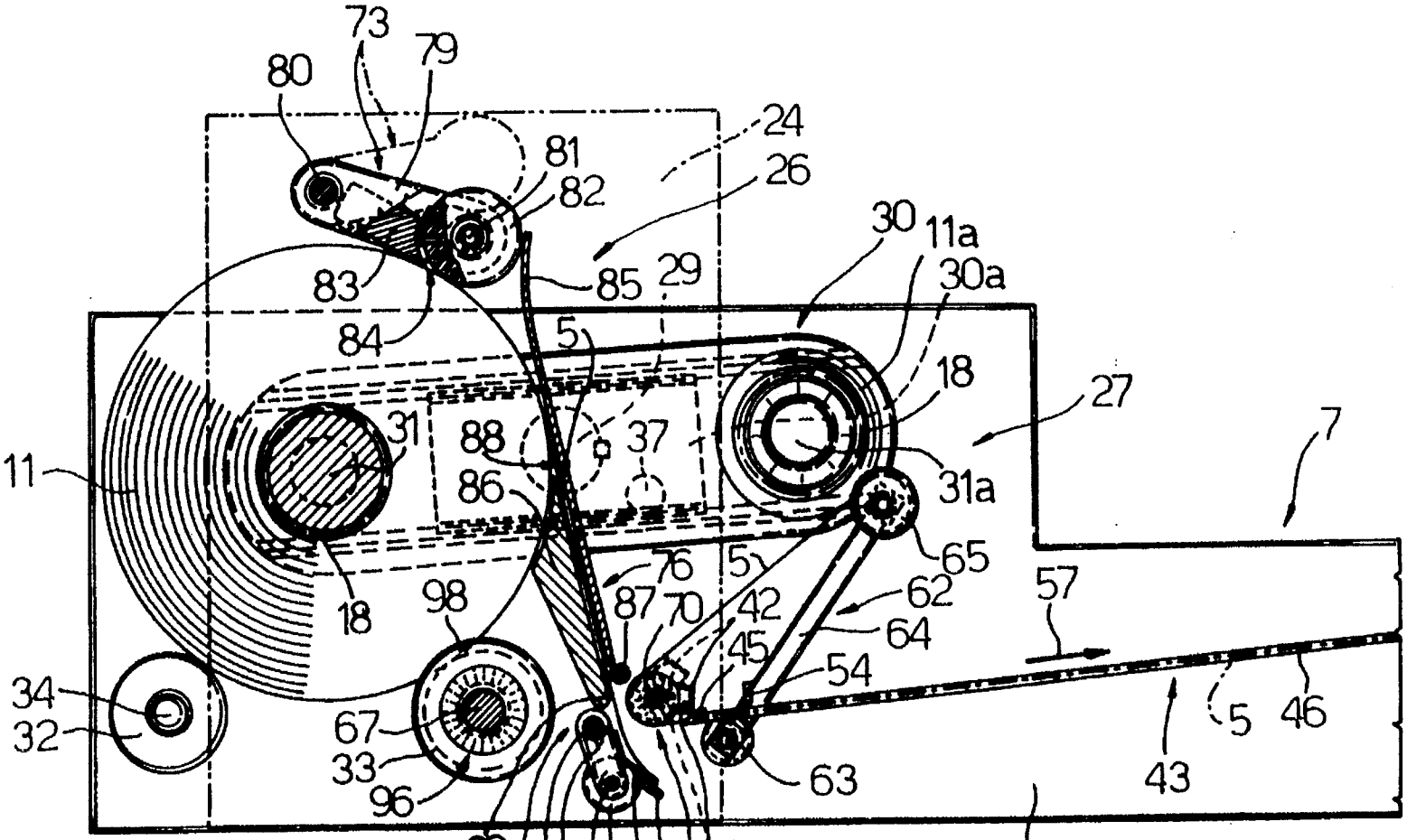
FIGS. 5 and 6 show the FIG. 2*a*, 2*b* and 3 details connected in a second and third operating position respectively.
Figure 6:
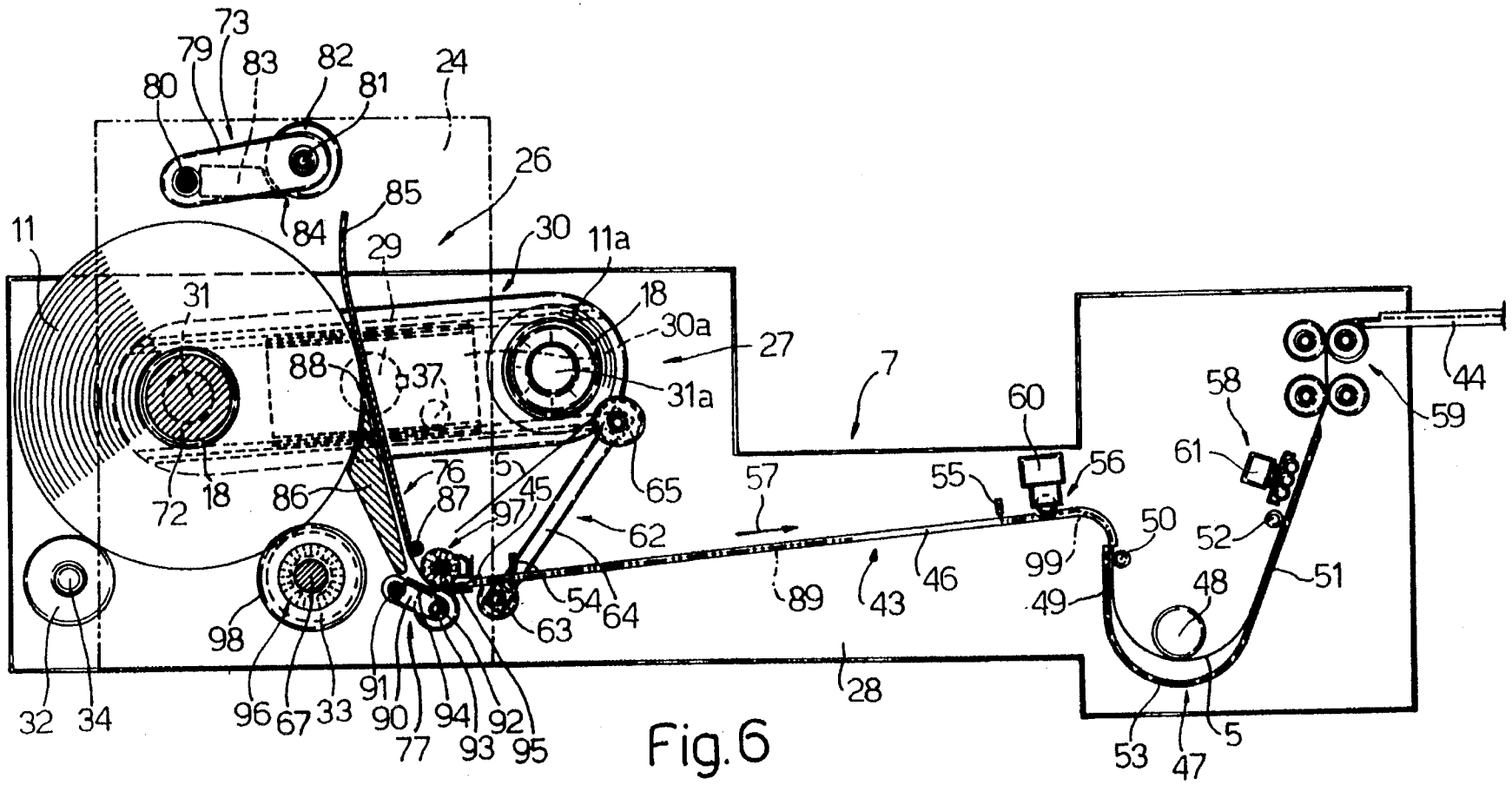

For a clearer understanding of the following description, and particularly the structure of stations 7 and module 26, it should be pointed out that, when connected to any one of stations 7, module 26 forms, with station 7, an automatic reel feed and change device as shown in FIGS. 5 and 6 and at least partly of the type described in Italian Patent Application n. 3426A/90, and equivalent U.S. Pat. No. 5,101,701, to which full reference is made herein in the interest of full disclosure.

Figures 2A, 2B:
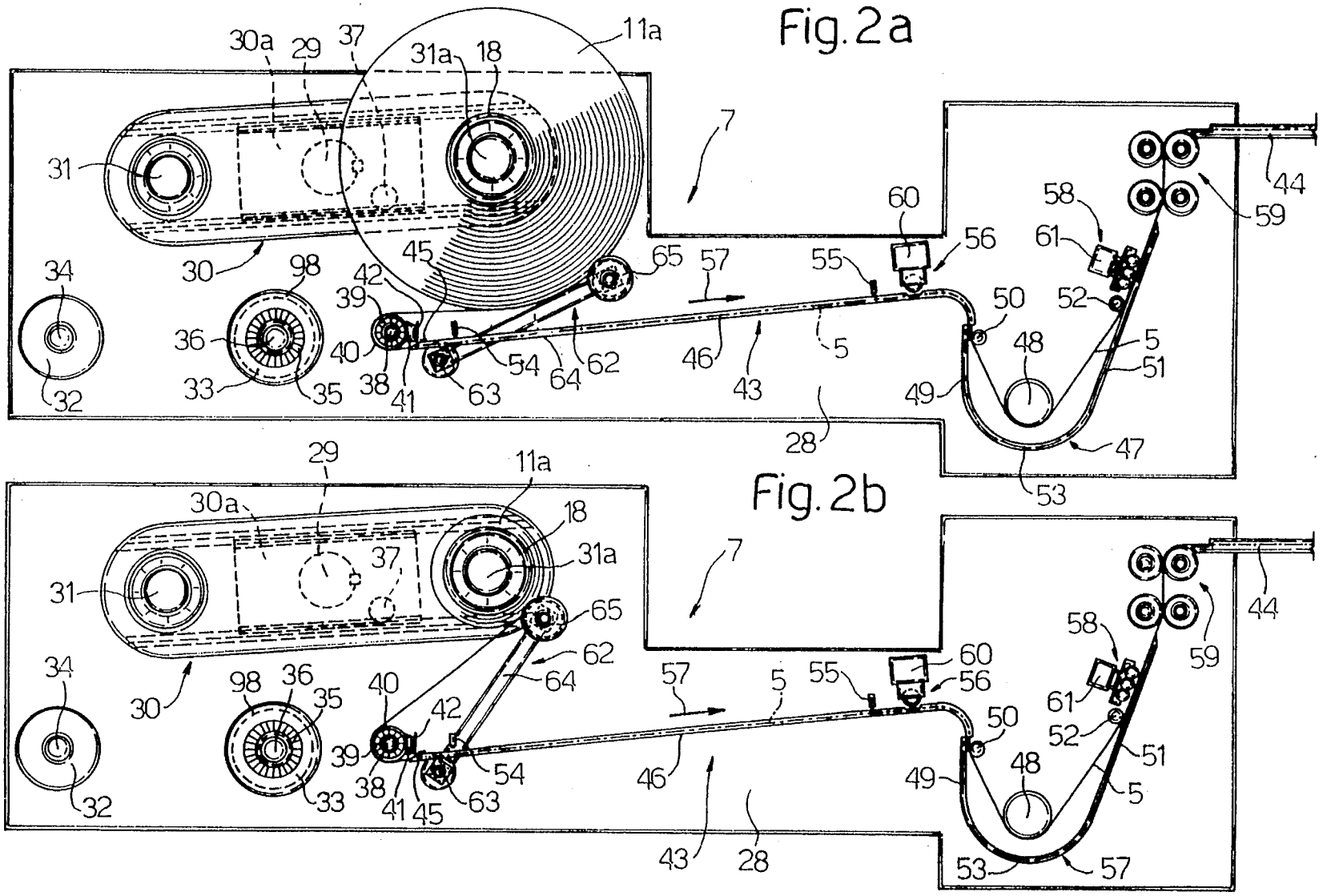
FIGS. 2*a* and 2*b* respectively illustrate a larger-scale view in perspective of a first detail of the FIG. 1 system in two different operating positions.

As shown in FIGS. 2*a*and 2*b*, each station 7 comprises a plate or frame 28 from which projects a powered shaft 29 parallel to slideway 8 and supporting a rocker arm 30. Rocker arm 30 rotates with shaft 29, and presents, at opposite ends, two pins 31 and 31*a* parallel to shaft 29 and projecting from rocker arm 30 on the opposite side to frame 28. More specifically, as reel 11*a* is unwound, rocker arm 30 is substantially horizontal, and pin 31 closest to slideway 8 engages core 18 of a full reel 11, while pin 31*a* engages core 18 of reel 11*a*.

When rocker arm 30 is in said horizontal unwinding position, pin 31 is centered over two rollers 32 and 33, the first of which is fitted in idle manner to a shaft 34 integral with frame 28 and parallel to shaft 29, and the second of which presents an integral face coupling 35, and is fitted in idle manner to an output shaft 36 on frame 28. Rocker arm 30 is fitted in sliding manner to a slideway 30*a* integral with and perpendicular to shaft 29, and is slid towards slideway 8 by a known actuator 37 fitted to slideway 30*a* and connected to rocker arm 30 via a rack and pinion connection (not shown), so as to move into a position of noninterference with roller 33, when rotated 180° clockwise (in FIG. 2) by and about the axis of shaft 29.

Substantially beneath shaft 29, frame 28 supports a rotary shaft 38 fitted on its free end with a face coupling 39 by which it is oscillated about its axis. Shaft 38 supports an idle roller 40, and is fitted with a transverse rod 41, the free end of which is fitted integral with a transverse blade 42. Roller 40 is a guide roller about which strip 5 of runoff reel 11*a* on pin 31*a* of rocker arm 30 is fed prior to engaging a guide 43 extending along frame 28, substantially horizontally and perpendicular to shaft 29, between roller 40 and the input guide 44 of respective machine 3, 4.

Guide 43 presents a substantially C-shaped, upwardly-concave section, and is closed at the top by a transverse blade 45 at an initial portion adjacent to the periphery of roller 40. Guide 43 comprises a first straight portion 46 sloping slightly upwards from roller 40; and a second curved portion 47 defining an upwardly-concave bend, and along which strip 5 is detached from guide 43, and is guided by a roller 48 supported in a fixed position by frame 28 inwards of portion 47. Portion 47 comprises a first downward input arm 49 with a guide roller 50 at the top end; a second upward output arm 51 with a guide roller 52 at the top end; and a curved intermediate connecting portion 53 extending about and beneath roller 48.

Frame 28 supports two sensors 54 and 55 respectively facing an initial and end portion of straight portion 46 of guide 43; a gumming device 56 facing an end portion of straight portion 46, downstream from sensor 55 in the traveling direction 57 of strip 5 along guide 43; and a pressure roller device 58 facing an output portion of arm 51, downstream from roller 52 and upstream from a guide roller unit 59 connecting guide 43 to guide 44. Gumming and pressure devices 56 and 58 are moved to and from an operating position contacting guide 43 by respective actuators 60 and 61 fitted to frame 28.

Beneath pin 31*a*, frame 28 supports a device 62 for detecting the amount of strip 5 remaining at any time on reel 11*a*. Device 62 comprises a shaft 63 mounted for rotation through frame 28 and fitted with a lever 64 in turn fitted in rotary manner on its free end with a feeler roller 65, which is held permanently contacting the periphery of reel 11*a* by a spring (not shown) interposed between lever 64 and frame 28.

Figure 4:
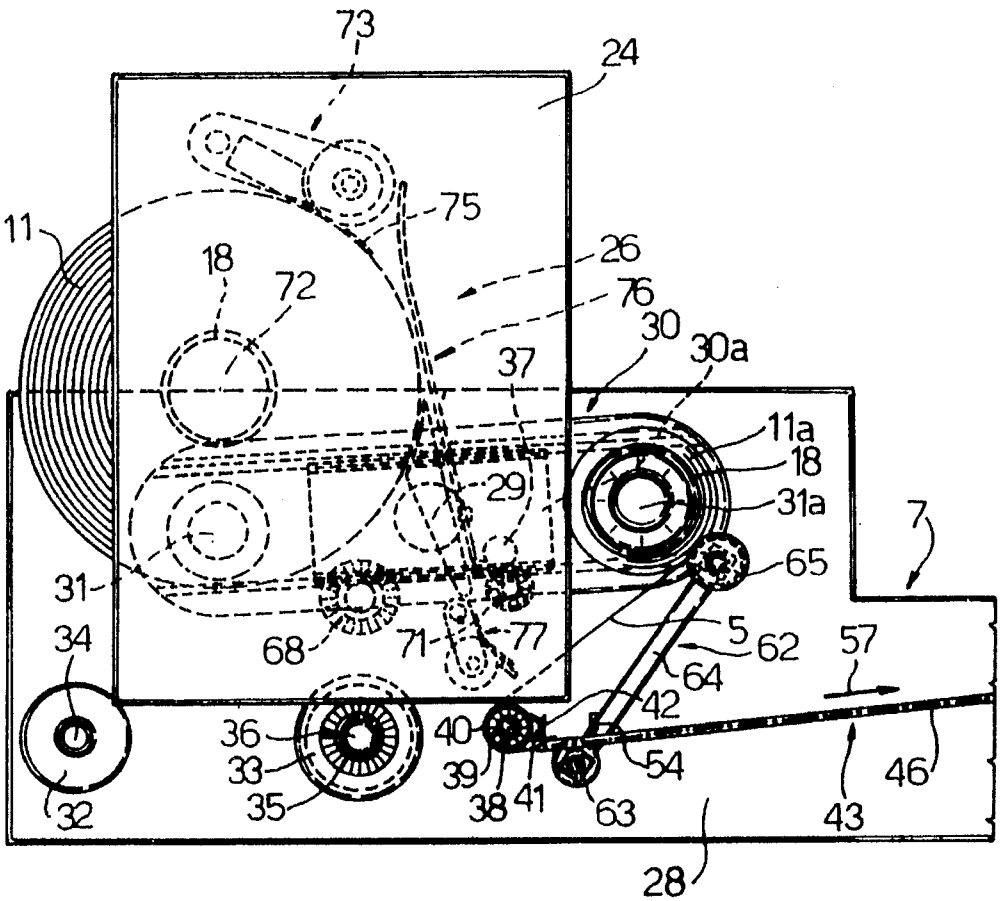
FIG. 4 shows the FIG. 2*a*, 2*b* and 3 details connected in a first operating position.
Figure 3:
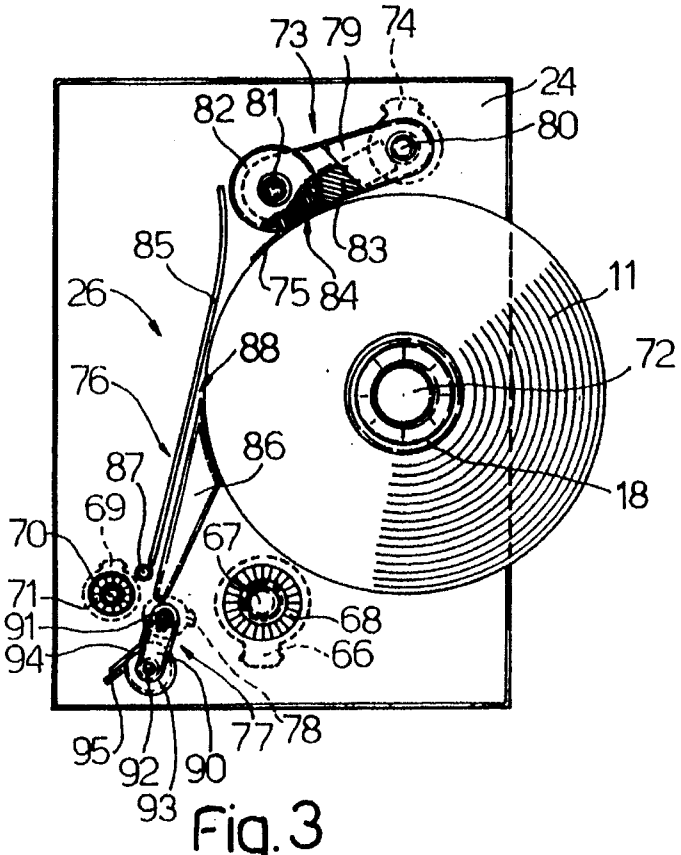
FIG. 3 shows a larger-scale view of a second detail of the FIG. 1 system.

As shown in FIGS. 3, 4 and 5, module 26 on slide 24 comprises a first reversible, variable-speed motor 66, the output shaft 67 of which is fitted with a face coupling 68 designed to engage face coupling 35, for rotating roller 33; a second motor 69, the output shaft 70 of which is fitted with a face coupling 71 designed to engage face coupling 39, for oscillating shaft 38 and blade 42; a pin 72 for supporting reel 11; a release device 73 movable by a motor 74 to and from an operating position wherein it releases the leading end of reel 11 on pin 72 by removing a gummed retaining element 75; and a guide device 76, the output portion of which is defined by a guide device 77 movable by a motor 78 to and from a position wherein the leading portion of strip 5 of reel 11 is inserted inside guide 43 and beneath blade 45.

Pin 72 is mounted in axially sliding manner on slide 24, and is held in the extracted position by an elastic element (not shown) interposed between pin 72 and slide 24.

Release device 73 is of the type described in U.S. Pat. No. 5,101,701, to which full reference is made herein in the interest of full disclosure, and comprises a frame or fork 79 fitted at one end to the output shaft 80 of motor 74, and fitted at the other end with a shaft 81 supporting in rotary manner a known suction roller 82. An intermediate portion of fork 79 supports a wedge 83, the cutting edge 84 of which, facing the periphery of roller 82, is moved by motor 74, and together with fork 79, between a raised idle position (shown by the dotted line in FIG. 5) and a lowered operating position (shown by the continuous line in FIG. 5) wherein cutting edge 84 and the periphery of roller 82 are both tangent to the periphery of reel 11 on pin 72.

Guide device 76 comprises a substantially vertical plate 85 substantially tangent to the periphery of reel 11 on pin 72; and a substantially triangular wedge 86 having a first curved side substantially tangent to the periphery of reel 11, and a second substantially straight side extending parallel to the bottom portion of plate 85 and in front of a guide roller 87, so as to define, with plate 85 and roller 87, a channel 88 along which the leading end portion 89 (FIG. 5) of strip 5 of reel 11 is fed.

Guide device 77 comprises a fork 90, a first end of which is fitted to the output shaft 91 of motor 78, and a second end of which is fitted with a shaft 92 supporting a roller 93, which is rotated clockwise (in FIG. 5) by a gear chain (not shown) comprising a first gear (not shown) integral with roller 93, a second gear (not shown) coaxial with shaft 91, and a third gear (not shown) fitted in a fixed position on slide 24 and interposed between said second gear and a gear (not shown) fitted to shaft 67. Fork 90 is fitted laterally with a curved plate 94 through which the periphery of roller 93 extends, and the free end of which is fitted with a sensor 95. Plate 94 is movable, together with fork 90 and about the axis of shaft 91, between a lowered idle position (FIG. 5) wherein fork 90 is substantially aligned with channel 88, and a raised operating position (FIG. 6) wherein the bottom end of plate 94 blends with the input of guide 43 when module 26 is connected to a station 7.

Operation of system 1 will now be described, for the sake of simplicity, relative to one station 7, and commencing with carriage 9 in any position along slideway 8; slide 22 in the raised position above stations 7; slide 24 in the backup position outside channels 25 and between stations 7 and slideway 8; and station 7 in question in the operating position shown in FIG. 2*a*, i.e. with reel 11*a* on pin 31*a* being unwound normally. Strip 5 of reel 11*a* is wound about roller 40 prior to engaging guide 43 beneath blade 45; is detached from curved portion 47 of guide 43 by winding about rollers 50, 52 and 48; and is fed through roller unit 59 prior to engaging guide 44, at the output of which it is connected to and unwound by a known traction unit (not shown, and forming part of respective machine 3, 4 of unit 2).

In the operating condition in FIG. 29, gumming device 56 and pressure device 58 are both maintained by respective actuators 60 and 61 in the raised position not contacting strip 5.

As strip 5 is unwound, the radius of reel 11*a* gradually gets smaller, so that lever 64 rotates anticlockwise (in FIG. 2*b*) about shaft 63. As reel 11*a* is about to run out, lever 64 activates a sensor (not shown), which emits a signal (different for each station 7) for activating robot 20. On receiving the enabling signal, robot 20 determines the emitting station 7 and, hence, the type of reel 11*a* running out, and performs a sequence of operations consisting in moving carriage 9 along slideway 8 to store 10 containing reels 11 of the same type as runout reel 11*a;* swinging arm 12 about axis 14 so that pin 16 is coaxial with and facing the first of reels 11; activating actuator 17, so as to effect a first axial movement of pin 16 and engage it inside core 18 of said reel 11; lowering slide 22; swinging arm 12 and reel 11 towards slide 24 in the lowered backup position, and into a transfer position wherein pin 16 is coaxial with pin 72; activating actuator 17 for effecting a further axial movement of pin 16 and engaging core 18 of reel 11 and pin 72; and, finally, activating actuator 17 so as to restore pin 16 to its original withdrawn position, and so release reel 11 on pin 72 in the position shown in FIGS. 3 and 4.

At this point, slide 22 is restored to the raised position over stations 7; carriage 9 moves along slideway 8 until slide 24 corresponds with channel 25 of runout reel 11*a*; slide 24 is moved into the extracted position; and slide 22 (FIGS. 4 and 5) is lowered so that (FIG. 5) pin 72 is coaxial with pin 31 of rocker arm 30 of station 7 in question, and shafts 67 and 70 are coaxial with shafts 36 and 38 of the same station 7. Further displacement of carriage 9 towards station 7 results in engagement of module 26 with station 7, and in the formation of device 27, in which engaged position, pin 31 engages core 18 of reel 11, thus releasing it from pin 72 which is withdrawable elastically, and face couplings 68 and 71 engage face couplings 35 and 39 so as to form two drive couplings 96 and 97.

In connection with FIGS. 3 and 4, it should be pointed out that the position of pins 72 and 31 is offset slightly upwards as compared with the position shown. In fact, when reel 11 is fitted on to pin 31, shaft 29 is rotated slightly (anticlockwise in FIG. 4), which rotation in no way affects unwinding of reel 11*a*, but enables the outer periphery of reel 11 to be inserted between two end flanges 98 on roller 33. This movement of shaft 29, which also provides for compensating for any minor differences in the diameter of reels 11, is controlled by a known torque detector (not shown) connected to shaft 29 and by which shaft 29 is arrested upon the periphery of reel 11 firmly contacting the periphery of rollers 32 and 33.

The above result may of course be achieved in other ways. For example, according to a variation not shown, pin 72 may be axially fixed but movable transversely by an actuator, and of such a length as to engage only part of core 18, so that, when both pins 31 and 72 engage core 18, pin 72 may be lowered taking rocker arm 30 passively with it.

In the FIG. 5 position, the torque detector (not shown) connected to shaft 29 activates both motor 66, for rotating roller 33 and reel 11 respectively clockwise and anticlockwise (in FIG. 5), and motor 74 for moving release device 73 into the lowered position wherein roller 82 and cutting edge 84 of wedge 83 contact the outer periphery of reel 11. During the above rotation, gummed element 75 is engaged by edge 84 of wedge 83 and so raised as to be removed by roller 82, which is rotated by friction by reel 11.

At this point, motor 66 is inverted so as to rotate reel 11 clockwise (in FIG. 5), feed the released leading portion 89 of strip 5 of reel 11 along channel 88 to plate 94 in the lowered position, and activate sensor 95, which arrests motor 66.

By the time reel 11 is supplied and assembled on to pin 31 in the standby position described above, reel 11*a* has continued unwinding and is close to running out. Before this occurs, however, lever 64 is intercepted by a further sensor (not shown) which activates motors 69 and 78. By means of a coupling 97, motor 69 rotates rod 41 anticlockwise (in FIG. 5) about shaft 38, so that blade 42 cuts strip 5 of reel 11*a* immediately upstream from roller 40, reel 11*a* is arrested, and a trailing portion 99 (FIG. 6) of the cut strip 5 is fed along guide 43; and motor 78 rotates fork 90 anticlockwise (in FIG. 5), so that the free end of plate 94 is aligned with and adjacent to the input of guide 43.

The passage past sensor 54 of the trailing edge of trailing portion 99 of strip 5, which is fed along guide 43 at a constant speed V1 by the traction unit (not shown) of respective machine 3, 4, activates motor 66, which, via coupling 96, rotates reel 11 clockwise (in FIGS. 5 and 6) so as to advance the leading portion 89 of strip 5 of reel 11 at a speed V2 greater than speed V1. By virtue of the position of plate 94, the free end of portion 89 is fed beneath blade 45 on to guide 43, and, by virtue of its higher speed V2, gets closer and closer to trailing portion 99 as it proceeds along guide 43.

As shown in FIG. 6, upon the trailing edge of trailing portion 99 moving past sensor 55, actuator 60 is operated so as to move gumming device 56 into the operating position and gum the upper surface of the end portion of trailing portion 99; after a given time lapse, actuator 61 (FIG. 8) is operated so as to lower pressure device 58 on to arm 51 of portion 47 of guide 43; and motor 66 is deactivated simultaneously with operation of actuator 61.

Figure 8:
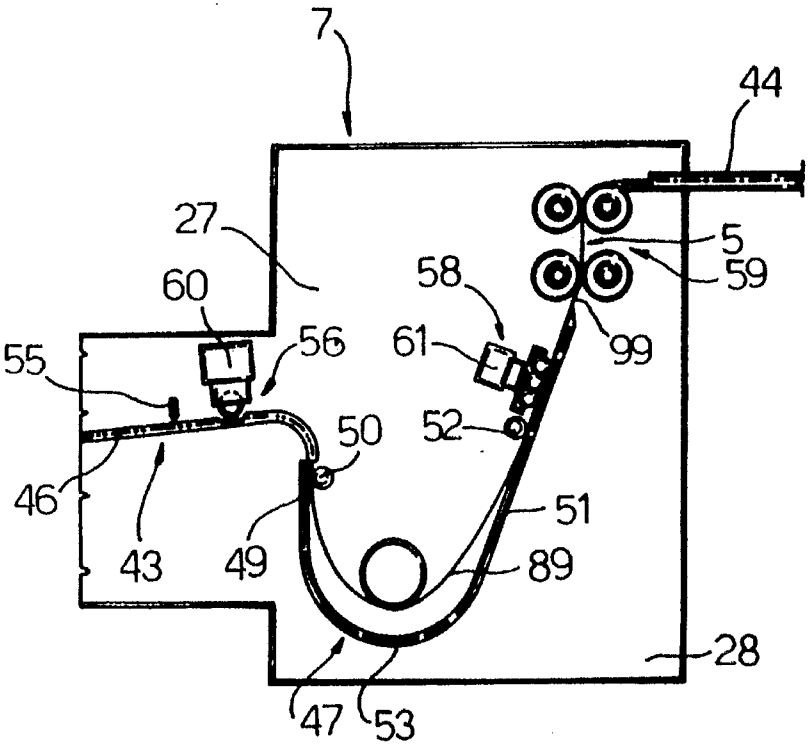
FIGS. 7 and 8 show a detail of FIG. 6 in two successive operating positions.
Figure 7:
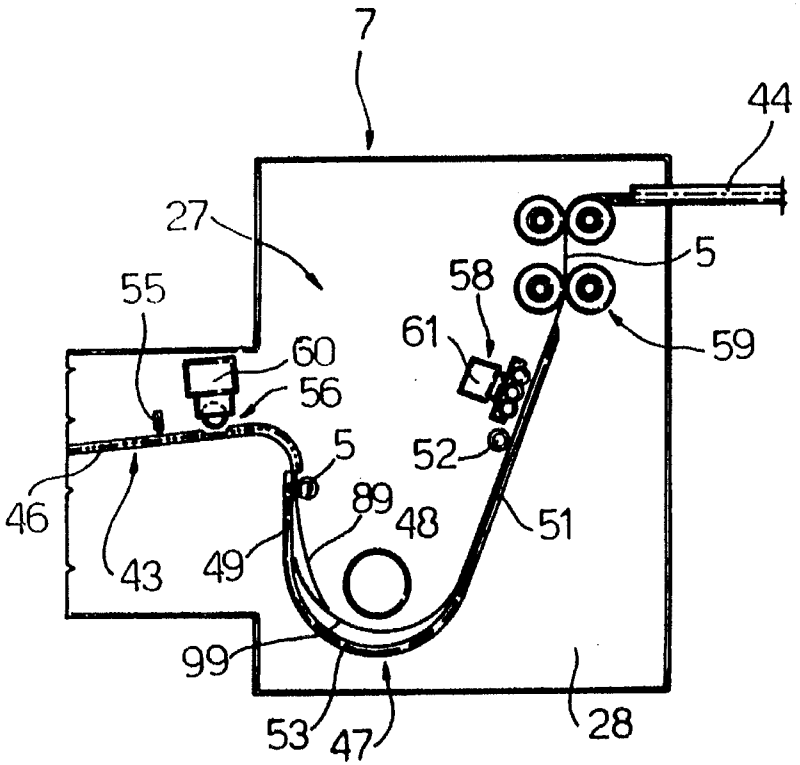

As shown in FIGS. 7 and 8, once the upper surface of the end portion of trailing portion 99 is gummed, gumming device 56 is raised to allow the passage of leading portion 89, which, by virtue of traveling at a faster speed, catches up with and partially overlaps trailing portion 99, in particular the gummed upper surface of the end portion of portion 99, as it travels along portion 47 of guide 43. As the two superimposed portions of portions 89 and 99 move past pressure device 58, actuator 61 of device 58 is activated so as to connect the cut strip 5 and strip 5 of reel 11, which, from this point on, is unwound by unit 2 at speed V1, while motor 66, as already stated, is deactivated.

At this point, module 26 is detached from station 7 by moving carriage 9 along slideway 8 and restoring robot 20 to its original standby position; and actuator 37 is operated in such a direction as to minimize the distance between pin 31*a* and the axis of shaft 29, prior to shaft 29 rotating rocker arm 30 180° clockwise (in FIG. 2*b*), i.e. in the opposite direction, so as to bring the new reel 11 into the position of reel 11*a* in FIG. 2*a*, and so enable removal, normally by hand, of core 18 of the runout reel.

What is claimed is:

1. A system (1) with a separate strip change unit (6) for supplying wrapping material in strip form; the strip change unit (6) comprising a plurality of unwinding stations (7), each supporting a respective reel (11*a*) for a respective runoff strip (5); and the system comprising, in addition to said strip change unit (6), an operating section (2) completely separated from the strip change unit (6) and defined by at least one machine (3, 4) employing strips (5) of wrapping material and operatively connected, in use, to said runoff strips (5) to unwind the respective reels (11*a*); the strip change unit (6) comprising a single robot (20) traveling along the unwinding stations (7) and in turn comprising an operating module (26) selectively connectable to each station (7); said module (26) comprising reel carrying means (72) to supply, in use each of said stations (7) selectively connected therewith with a full reel (11), and combining, in use, with each of said stations (7) selectively connected therewith to constitute a respective device (27) for replacing the relevant runout reel (11*a*).

2. A system as claimed in claim 1, wherein the unwinding stations (7) are at least partly passive; said robot (20) being an active robot; and said operating module (26) comprising actuating means (66, 68–69, 71) selectively connectable to each unwinding station (7), for powering the unwinding stations (7) during replacement of the runout reels (11*a*).

3. A system as claimed in claim 2, wherein each said unwinding station (7) comprises a first supporting element (31) for a full reel (11); said supply means (72) comprising a second supporting element (72) for a full reel (11); and said operating module (26) being movable to and from an operating position wherein said second supporting element (72) is positioned adjacent to said first supporting element (31), for transferring said full reel (11) on to said first supporting element (31).

4. A system as claimed in claim 3, wherein each said unwinding station (7) also comprises roller means (33) associated with said first supporting element (31) and cooperating with said full reel (11) for rotating the full reel (11) about its axis; said operating module (26) comprising first activating means (66, 68) for said roller means (33); and said first activating means (66, 68) being connected to said roller means (33) when the operating module (26) is in said operating position.

5. A system as claimed in claim 4, wherein said module (26) also comprises a release device (73) for releasing said full reel (11) on said first supporting element (31).

6. A system as claimed in claim 5, wherein said release device (73) comprises wedge means (83) movable to and from a position contacting the outer peripheral surface of said full reel (11), and tangentially in relation to said peripheral surface, for removing a gummed element (75) securing said full reel (11).

7. A system as claimed in claim 3, wherein each said unwinding station (7) also comprises guide means (43) for a runoff strip (5); and cutting means (42) for cutting said strip (5); said module (26) also comprising a guide device (76) for positioning in a standby position the leading portion (89) of the strip (5) of said full reel (11) on said first supporting element (31); powered guide means (77) for moving said leading portion (89) from said standby position to a position wherein it engages said guide means (43); and second activating means (69, 71) connectable, in said operating position, to said cutting means (42), for moving said cutting means (42) to and from a position in which said runoff strip (5) is cut.

8. A system as claimed in claim 3, further comprising storage means (10) for storing said full reels (11); and means (12) for successively transferring said full reels (11) from said storage means (10) to said second supporting element (72) of said operating module (26).

9. A system as claimed in claim 8, wherein said transfer means (12) forms part of said robot (20), and is movable with said operating module (26) along said unwinding station (7).

10. A system as claimed in claim 3, wherein said module (26) also comprises a release device (73) for releasing said full reel (11) on said first supporting element (31).

* * * * *